US009711921B2

(12) United States Patent
Byrne et al.

(10) Patent No.: US 9,711,921 B2
(45) Date of Patent: Jul. 18, 2017

(54) ELECTRICAL CONTACT RECEPTACLE FOR BUS BARS AND BLADE TERMINALS

(71) Applicants: Norman R. Byrne, Ada, MI (US); Robert L. Knapp, Rockford, MI (US); Steven K. Meek, Grand Rapids, MI (US); Matthew R. Andree, Rockford, MI (US); David J. Battey, Caledonia, MI (US)

(72) Inventors: Norman R. Byrne, Ada, MI (US); Robert L. Knapp, Rockford, MI (US); Steven K. Meek, Grand Rapids, MI (US); Matthew R. Andree, Rockford, MI (US); David J. Battey, Caledonia, MI (US)

( * ) Notice: Subject to any disclaimer, the term of this patent is extended or adjusted under 35 U.S.C. 154(b) by 0 days.

(21) Appl. No.: 15/054,708

(22) Filed: Feb. 26, 2016

(65) Prior Publication Data

US 2016/0254627 A1 Sep. 1, 2016

Related U.S. Application Data

(60) Provisional application No. 62/121,571, filed on Feb. 27, 2015.

(51) Int. Cl.

| | |
|---|---|
| ***H01R 31/08*** | (2006.01) |
| ***H01R 25/14*** | (2006.01) |
| ***H01R 24/76*** | (2011.01) |
| ***H01R 11/01*** | (2006.01) |
| ***H01R 13/11*** | (2006.01) |

(52) U.S. Cl.

CPC ..... *H01R 25/145* (2013.01); *H01R 11/01* (2013.01); *H01R 13/113* (2013.01); *H01R 24/76* (2013.01); *H01R 25/142* (2013.01); *H01R 31/08* (2013.01); *H01R 31/085* (2013.01)

(58) Field of Classification Search

None

See application file for complete search history.

(56) References Cited

U.S. PATENT DOCUMENTS

| | | | |
|---|---|---|---|
| 1,477,527 | A | 12/1923 | Raettig |
| 2,499,297 | A | 2/1950 | Buchanan |
| 3,118,998 | A | 1/1964 | Mastney et al. |
| 3,162,501 | A | 12/1964 | Wahl |
| 3,183,471 | A | 5/1965 | Burkert |
| 3,245,024 | A | 4/1966 | Evans |

(Continued)

OTHER PUBLICATIONS

International Search Report and Written Opinion for corresponding PCT Application No. PCT/US2016/019782, dated Jul. 11, 2016.

*Primary Examiner* — Tho D Ta

(74) *Attorney, Agent, or Firm* — Gardner, Linn, Burkhart & Flory, LLP

(57) ABSTRACT

An electrical contact receptacle includes a base with opposed contact portions extending from one surface thereof. Each contact portion has three arms in spaced arrangement, and optionally a bridge portion extending across outboard arms. Each of arms has an inner contact surface for conductively engaging a blade terminal or a bus bar. Optionally, the base defines an opening through which a tip portion of a blade terminal can be received, thereby permitting insertion of the blade terminal from above or below the contact receptacle, and allowing for additional contact surfaces with the blade terminal.

20 Claims, 7 Drawing Sheets

(56) References Cited

U.S. PATENT DOCUMENTS 3,346,834 A 10/1967 Kinkaid
3,514,737 A 5/1970 Renshaw
3,915,544 A * 10/1975 Yurtin ..... H05K 3/326 439/747
3,955,869 A 5/1976 Licht
4,175,821 A 11/1979 Hunter
4,353,610 A * 10/1982 Deters ..... H01R 31/085 439/510
4,391,480 A 7/1983 Mina
4,445,747 A 5/1984 Neidich
4,545,638 A 10/1985 Neidich
4,596,429 A * 6/1986 Gierut ..... H01R 31/08 439/510
4,737,115 A 4/1988 Seidler
4,795,379 A 1/1989 Sasaki et al.
4,813,881 A 3/1989 Kirby
4,883,435 A 11/1989 Seidler
4,887,976 A 12/1989 Bennett et al.
4,932,906 A 6/1990 Kaley et al.
4,944,691 A 7/1990 Marach
4,990,110 A * 2/1991 Byrne ..... H01R 13/11 439/861
4,995,814 A 2/1991 Weidler
5,008,493 A 4/1991 Wagener
5,024,610 A 6/1991 French et al.
5,024,627 A 6/1991 Bennett et al.
5,052,954 A 10/1991 Seidler
5,064,379 A * 11/1991 Ryll ..... H01R 9/091 439/81
5,334,059 A 8/1994 Seidler
5,402,315 A 3/1995 Reichle
5,509,819 A * 4/1996 Stein, Sr. ..... H01R 13/4364 439/189
5,564,952 A 10/1996 Davis
5,618,187 A 4/1997 Goto
5,655,930 A * 8/1997 Dechelette ..... H01R 12/716 439/510
5,934,950 A 8/1999 Yeow
6,017,253 A 1/2000 Schramme
6,036,534 A * 3/2000 Hoyt ..... H01R 31/08 439/483
6,099,322 A 8/2000 Beloritsky et al.
6,102,754 A 8/2000 Capper et al.
6,123,587 A 9/2000 Beloritski et al.
6,132,238 A 10/2000 Hartmann et al.
6,383,039 B1 5/2002 Yoneyama et al.
6,402,571 B1 6/2002 Muller et al.
6,464,547 B2 10/2002 Ketelsleger
6,494,754 B2 12/2002 Cachina et al.
6,705,902 B1 3/2004 Yi et al.
6,749,470 B2 6/2004 Dangelmaier
6,776,635 B2 8/2004 Blanchfield et al.
6,932,660 B2 8/2005 Roepke
7,083,433 B2 8/2006 Misawa et al.
7,425,145 B2 9/2008 Ngo
7,581,965 B1 * 9/2009 Upasani ..... H05K 3/32 439/82
7,726,982 B2 6/2010 Ngo
7,762,857 B2 7/2010 Ngo et al.
7,771,244 B1 8/2010 Ju
7,775,822 B2 8/2010 Ngo et al.
7,862,359 B2 1/2011 Daily et al.
7,892,050 B2 2/2011 Pavlovic et al.
7,905,731 B2 3/2011 Ngo et al.
7,967,648 B2 6/2011 Byrne
8,096,814 B2 1/2012 Schell
8,182,299 B2 5/2012 Schrader
8,262,401 B1 9/2012 Byrne
8,616,926 B2 * 12/2013 Byrne ..... H01R 4/48 439/861
8,771,026 B2 * 7/2014 Lin ..... F16B 2/245 439/786
9,246,317 B2 1/2016 Byrne et al.
2002/0081916 A1 6/2002 Wertz et al.
2005/0014423 A1 1/2005 Roepke
2005/0042939 A1 2/2005 Wertz et al.
2006/0003620 A1 1/2006 Daily et al.
2006/0046582 A1 3/2006 MacKness
2007/0259574 A1 11/2007 Kirstein et al.
2011/0039458 A1 2/2011 Byrne
2011/0217882 A1 9/2011 Gassauer
2012/0156947 A1 6/2012 Tyler

* cited by examiner

ELECTRICAL CONTACT RECEPTACLE FOR BUS BARS AND BLADE TERMINALS

CROSS REFERENCE TO RELATED APPLICATION

The present application claims the benefit of U.S. provisional application Ser. No. 62/121,571, filed Feb. 27, 2015, which is hereby incorporated herein by reference in its entirety.

FIELD OF THE INVENTION

The present invention relates to electrical connectors and, more particularly, to female electrical contacts or terminals configured to receive bus bars.

BACKGROUND OF THE INVENTION

Bus bar receptacles are configured to receive and establish electrical connections with corresponding electrical bus bars, which are typically blade-like and generally planar conductors. Together, bus bars and bus bar receptacles are used to establish electrical connections that may be capable of carrying high electrical currents.

SUMMARY OF THE INVENTION

The present invention provides a bus bar contact receptacle that is capable of receiving a bus bar that is inserted into the receptacle from two or more different directions, and which establishes multiple points of contact where discrete surfaces of the bus bar establish an electrical connection with the receptacle. For example, the bus bar contact receptacle may be configured to receive a bus bar inserted from any of four or more different directions, and may establish at least six points or locations of electrical contact with the bus bar. This arrangement provides or establishes a low-resistance electrical connection between a bus bar and the contact receptacle, which connection is capable of transmitting high current loads, and also permits a bus bar to be inserted into the receptacle from many different directions according to the needs of a particular application, so that the bus bar contact receptacle need not have its orientation changed to accommodate the direction from which a given bus bar will be inserted.

According to one form of the present invention, a contact receptacle for bus bars and male blade terminals includes a base with a pair of opposed contact portions extending therefrom. The base includes a front surface and a pair of opposite side edge regions from which the contact portions extend. The base defines a through-opening between opposite side edge regions of the base, so that the through-opening passes through the front surface. The contact portions extend forwardly of the front surface, and each has a respective inner contact surface for conductively engaging a blade terminal or a bus bar. The opening formed in the base is configured to receive a blade terminal that is oriented generally perpendicular to the base, and the base is thereby capable of establishing an electrical contact with the blade terminal at the opening, simultaneously with the contact portions conductively engaging the blade terminal.

In one aspect, the contact receptacle establishes six or more separate points of contact with a blade terminal or bus bar that is engaged with the contact receptacle in any of at least four different insertion directions. For example, a blade terminal or bus bar inserted from a distal or proximal end of the contact receptacle establishes at least three separate points of contact with each of the pair of opposed contact portions, and may further establish at least one additional point of contact with the front surface of the base. A blade terminal or bus bar inserted from a front (i.e. toward the front surface of the base) or from a rear, establishes at least three separate points of contact with each of the pair of opposed contact portions, and may further establish at least one additional point of contact with the base at an edge or surface defining the through-opening.

Optionally, each of the contact portions has a forward arm, a rearward arm, and a middle arm disposed between the forward and rearward arms. A bridge portion extends transversely between or across the forward and rearward arms at distal or ends thereof. Each of arms has an inner contact surface for conductively engaging a blade terminal or a bus bar at a distinct location therealong.

Thus, the bus bar contact receptacle of the present invention is capable of establishing a low-resistance, high-capacity electrical connection when a bus bar is inserted from any one of a plurality of different directions.

These and other objects, advantages, purposes and features of the present invention will become apparent upon review of the following specification in conjunction with the drawings.

DESCRIPTION OF THE PREFERRED EMBODIMENTS

Figure 2:
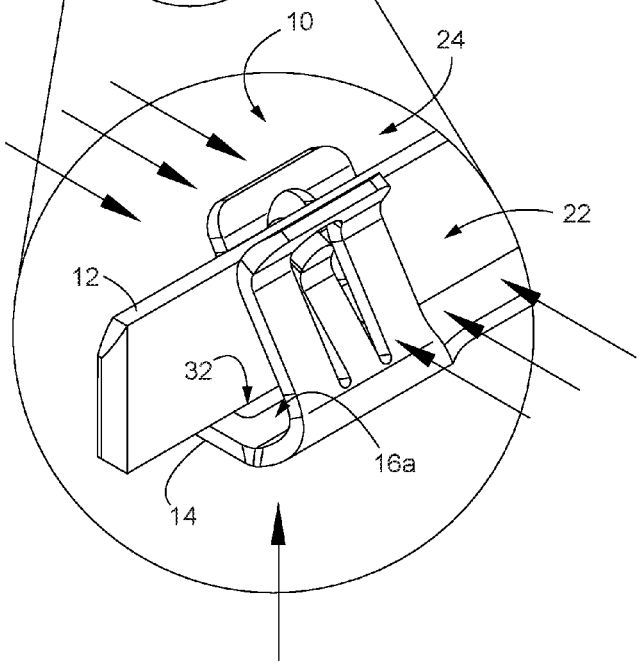
FIG. 2 is another perspective view of the bus bar contact receptacle and bus bar of FIG. 1, including an enlarged view of a contact region, in which the bus bar is fully inserted.
Figure 3:
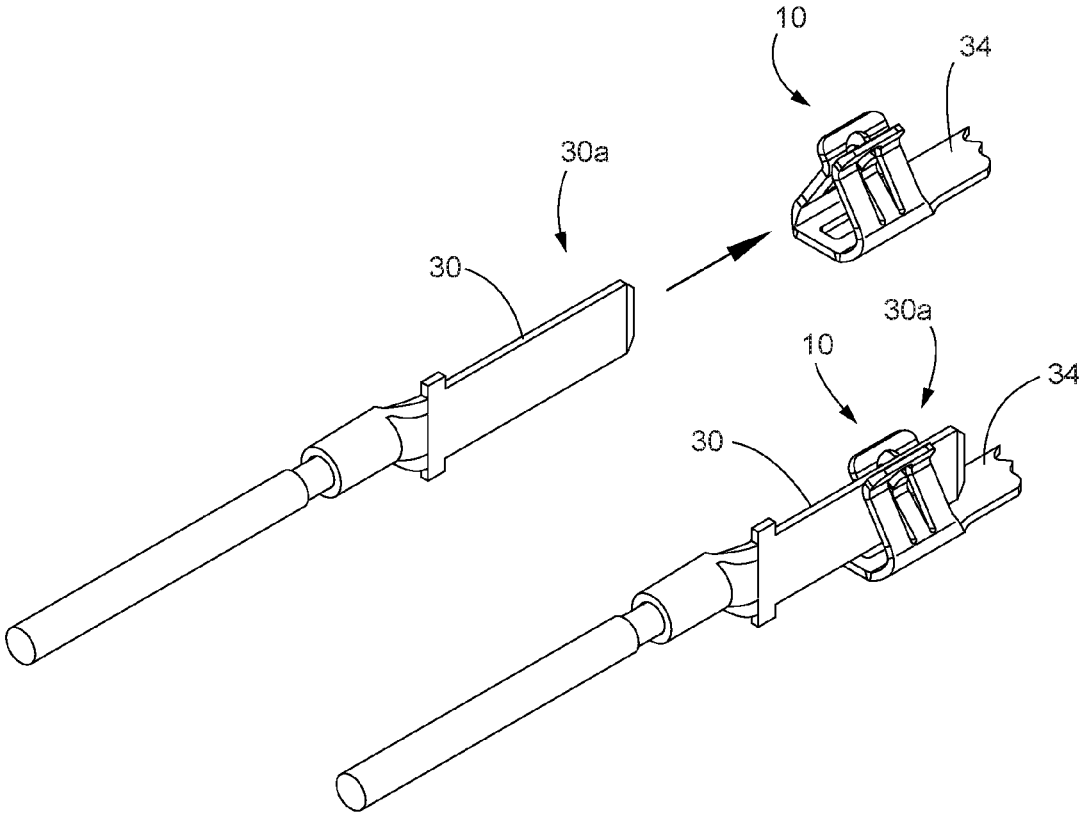
FIG. 3 is a perspective view of the bus bar contact receptacle shown receiving a bus bar from a distal end thereof.
Figure 4:
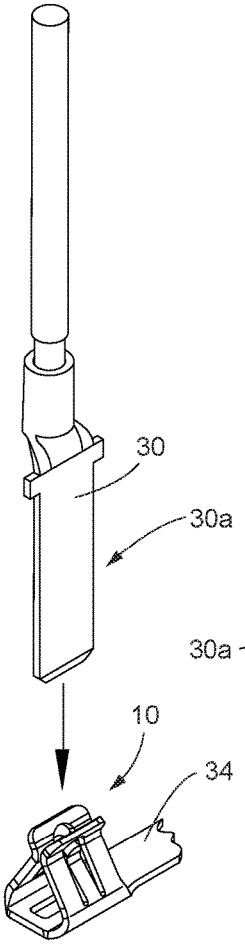
FIG. 4 is a perspective view of the bus bar contact receptacle shown with a perpendicular-oriented bus bar prior to insertion from above.

Referring now to the drawings and the illustrative embodiments depicted therein, an electrical bus bar contact receptacle 10 is configured to receive a bus bar 12 that is insertable into the receptacle 10 from different directions, such as from above (FIGS. 1, 2, 4 and 5), from below (FIG. 6), and from opposite sides or ends (FIG. 3). Bus bar contact receptacle 10 is capable of establishing multiple points of contact with bus bar 12, substantially regardless of the direction of insertion, as will be described in more detail below. This creates a low-resistance electrical connection between bus bar 12 and contact receptacle 10, thus permitting the resulting electrical connection to carry high current loads without excessive build-up of heat, and reducing the likelihood that a give receptacle will need to be re-oriented to receive a bus bar from a different direction. It will be appreciated that, for purposes of this description, directional terms such as "above", "below", "front", "rear", "left", "right", "sides", "proximal" and "distal" are all relative terms used to facilitate understanding with reference to the appended drawings, and are not intended to be limiting since the orientation of the contact receptacle can be changed as desired, according to the operating environment in which it is used.

Electrical bus bar contact receptacle 10 includes a generally planar base 14 having a front or top surface 16*a* and a rear or bottom surface 16*b*, a forward or distal end region 18*a* and a rearward or proximal end region 18*b*, and a left side edge region 20*a* and a right side edge region 20*b* (FIGS. 7-14). Contact receptacle 10 further includes a left contact portion 22 and a right contact portion 24, each contact portion 22, 24 extending or projecting forwardly or upwardly from front surface or top surface 16*a*. Each contact portion 22, 24 further includes respective proximal end portions 22*a*, 24*a* where contact portions 22, 24 join planar base 14 at left side edge region 20*a* and right side edge region 20*b*, respectively.

Figure 1:
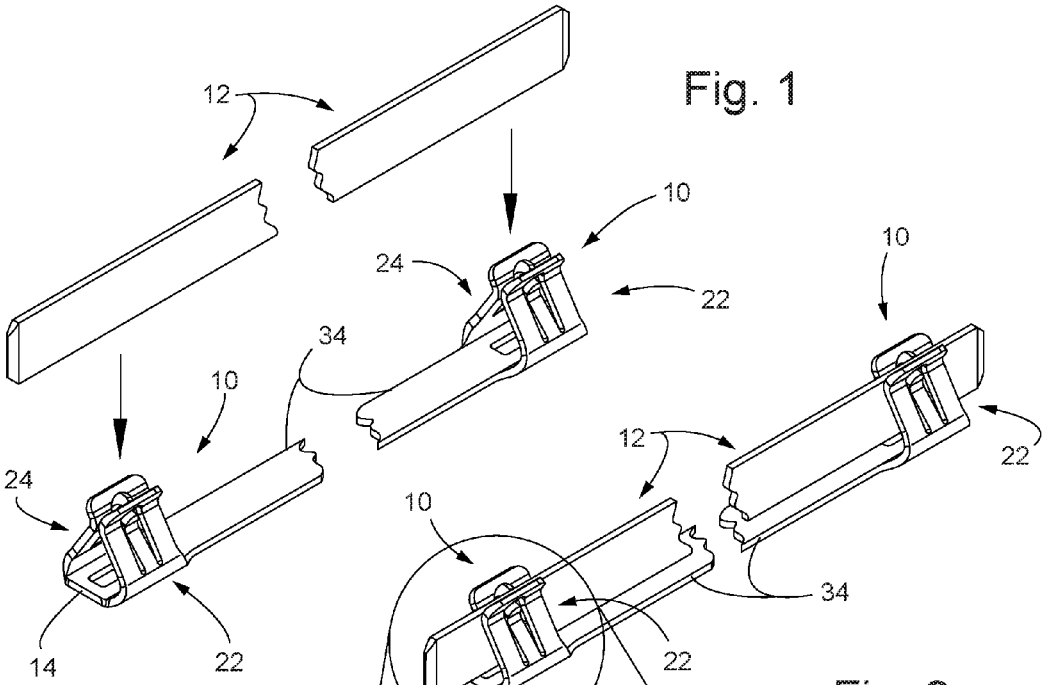
FIG. 1 is a perspective view of a bus bar contact receptacle in accordance with the present invention, shown with a parallel-oriented bus bar prior to insertion from above.
Figure 9:
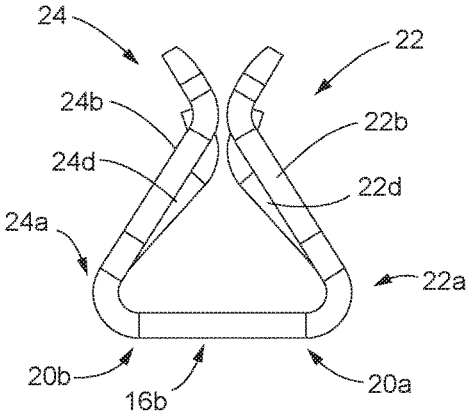
FIG. 9 is a proximal end elevation of the bus bar contact receptacle.
Figure 10:
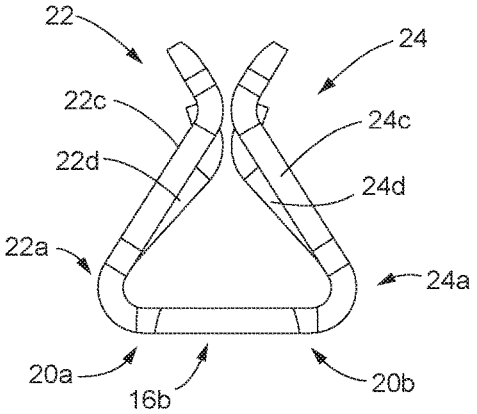
FIG. 10 is a distal end elevation of the bus bar contact receptacle.
Figure 11:
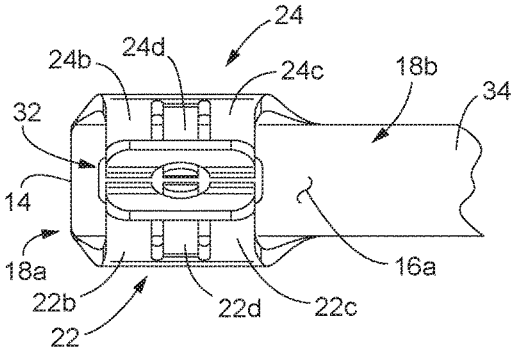
FIG. 11 is a top plan view of the bus bar contact receptacle.
Figure 13:
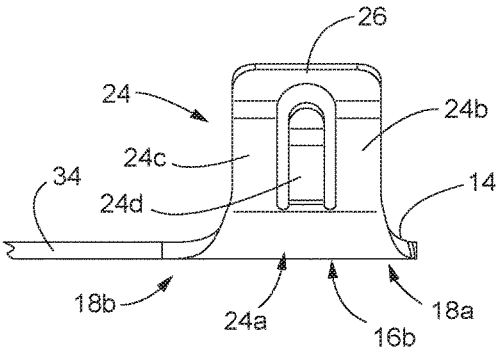
FIG. 13 is a right side elevation of the bus bar contact receptacle.
Figure 14:
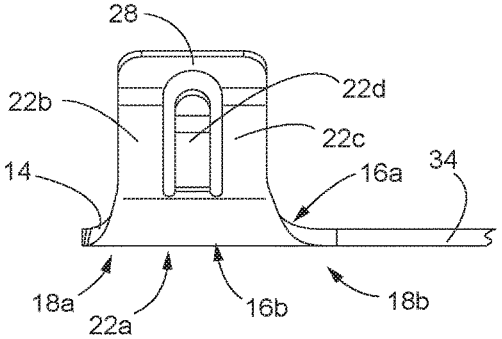
FIG. 14 is a left side elevation of the bus bar contact receptacle.

The left contact portion 22 and the right contact portion 24 each has a respective forward or distal arm 22*b*, 24*b* at or near forward or distal end region 18*a* of the base 14, plus a respective rearward or proximal arm 22*c*, 24*c* at or near rearward or proximal end region 18*b* of the base 14. In addition to the forward/distal arms and rearward/proximal arms of each contact portion 22, 24, left contact portion 22 has a middle or central arm 22*d* positioned between the forward arm 22*b* and the rearward arm 22*c*, and right contact portion 24 has a middle or central arm 24*d* positioned between the forward arm 24*b* and the rearward arm 24*c*. Each arm (22*b*, 22*c*, 22*d*, 24*b*, 24*c*, 24*d*) is generally canted inwardly and has an outwardly-flared tip portion in a mirror-image arrangement, such as shown in FIGS. 9 and 10. In addition, the right contact portion's outboard arms 24*b*, 24*c* are connected at their distal ends by a bridge portion 26 that is spaced above middle arm 24*d*, such as shown in FIG. 13. Similarly, the left contact portion's outboard arms 22*b*, 22*c* are connected at their distal ends by a bridge portion 28 that is spaced above middle arm 22*d*, such as shown in FIG. 14. Thus, each bridge portion 26, 28 extends transversely between and conductively attaches to respective distal end portions of the respective forward and rearward arms 24*b*, 24*c* and 22*b*, 22*c*. The distal end portions of the forward arms 22*b*, 24*b*, the rearward arms 22*c*, 24*c*, and the middle arms 22*d*, 24*d* each define a respective inner contact surface for conductively engaging a blade terminal 30 (FIGS. 3-6) or bus bar 12 (FIGS. 1 and 2).

Referring to 9 and 10, the proximal or base end 22*a* of left contact portion 22 is spaced apart from the proximal end portion 24*a* of right contact portion 24 by a first distance generally corresponding to a width of the base 14 measured from the left side edge region 20*a* to the right side edge region 20*b*. The inner contact surfaces of left contact portion 22 are spaced from the inner contact surfaces of right contact portion 24 by a second distance that is less than the first distance generally corresponding to the width of base 14, including when left contact portion 22 and right contact portion 24 engage the blade terminal 30 or bus bar 12. Each of the inner contact surfaces of said opposed contact portions comprises a convex curved shape, such as shown in FIGS. 9 and 10.

Figure 5:
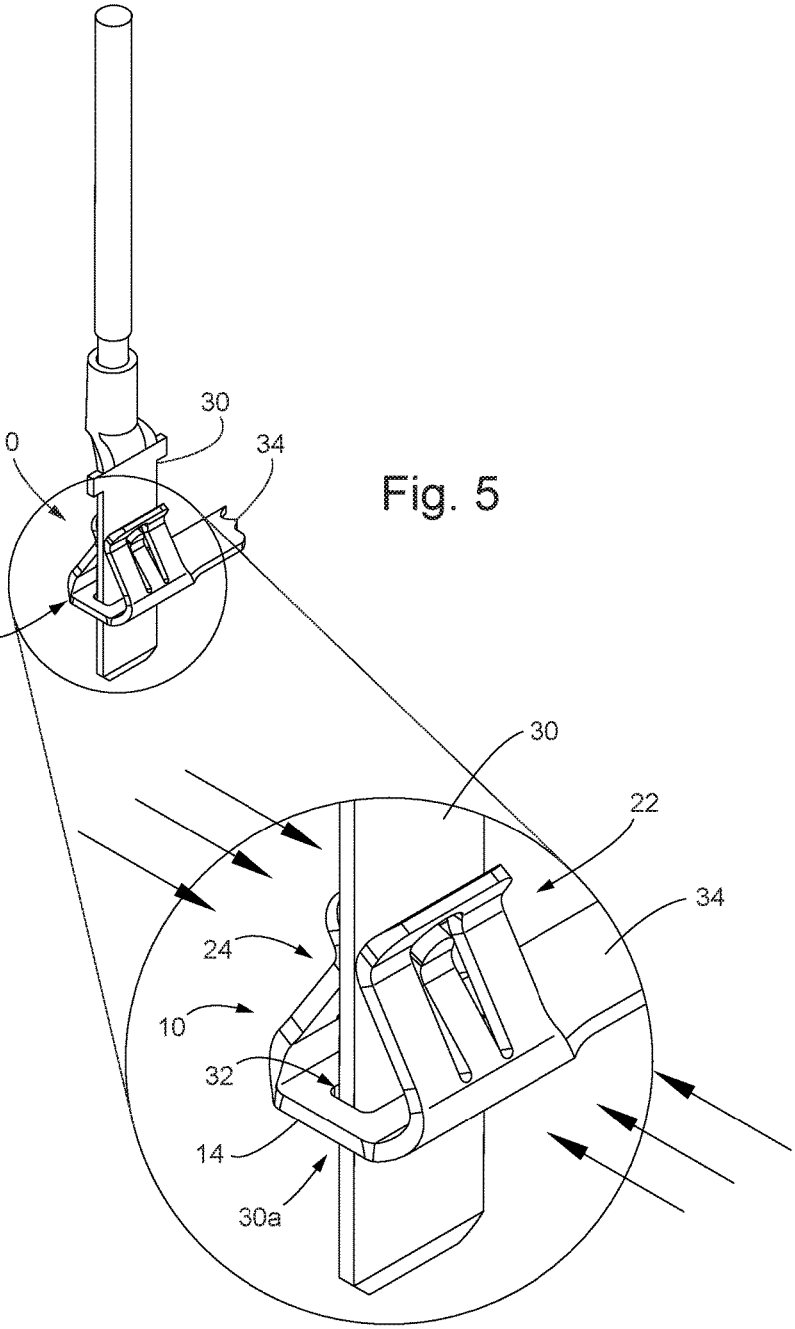
FIG. 5 is a perspective view of the bus bar contact receptacle and perpendicular-oriented bus bar of FIG. 4, including an enlarged view of the contact region, in which the bus bar is fully inserted.
Figure 6:
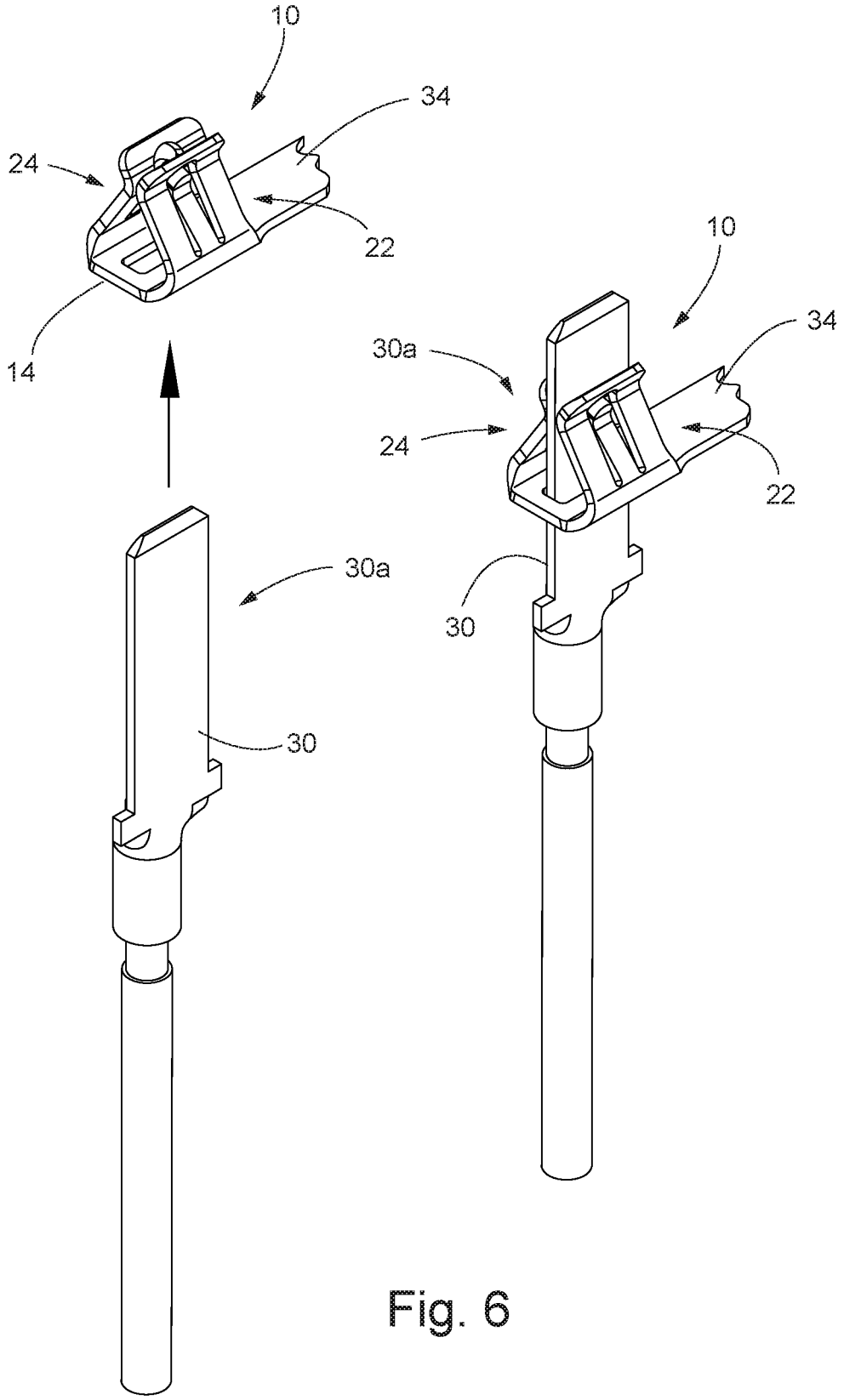
FIG. 6 is a perspective view of the bus bar contact receptacle shown receiving a perpendicular-oriented bus bar from below.

It will be appreciated that, to ensure that a sufficient electrical contact is established between electrical bus bar contact receptacle 10 and the blade terminal 30 or bus bar 12, the arms of the left and right contact portions 22, 24 are spaced more closely together in the relaxed non-engaged position of FIGS. 1, 4 and 7-12 than when engaged by blade terminal 30 or bus bar 12 as in FIGS. 2 and 5. In other words, the thickness of the blade terminal 30 or bus bar 12 is greater than the spacing of the inner contact surfaces of the contact portions 22, 24 in the relaxed non-engaged position, such that the arms of the left and right contact portions 22, 24 are spread further apart upon insertion of the blade terminal or bus bar. Left and right contact portions 22, 24 are made of a resilient material so as to apply a spring force (shown with six opposing arrows in FIG. 2, which also generally indicate the contact locations) and thereby frictionally engage and retain blade terminal 30 or bus bar 12 while establishing good electrical contact.

Figure 7:
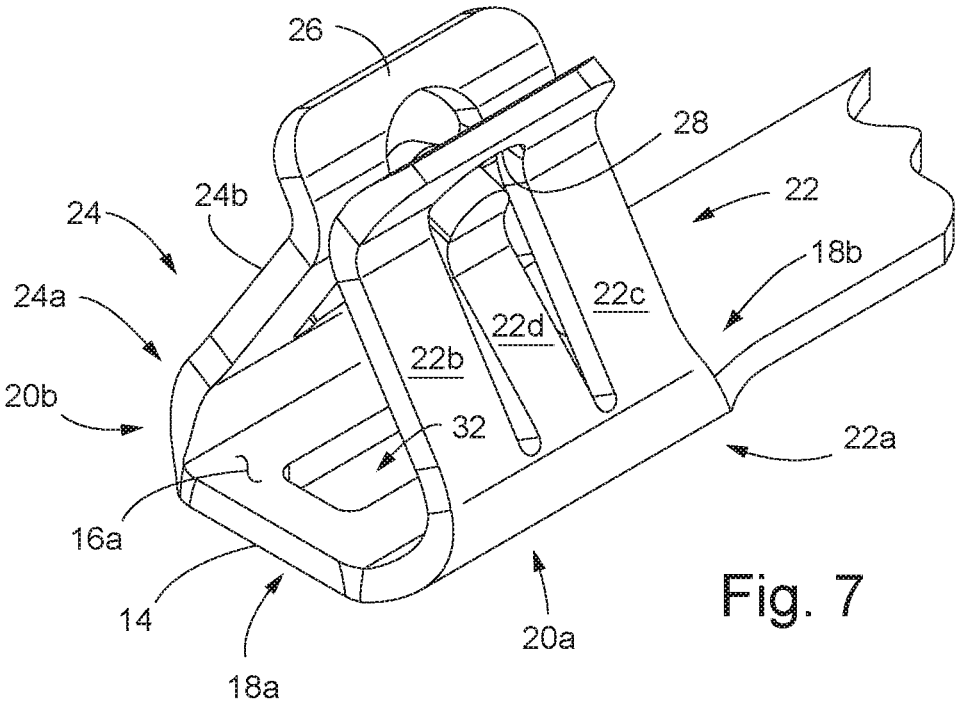
FIG. 7 is an enlarged top perspective view of the bus bar contact receptacle.
Figure 8:
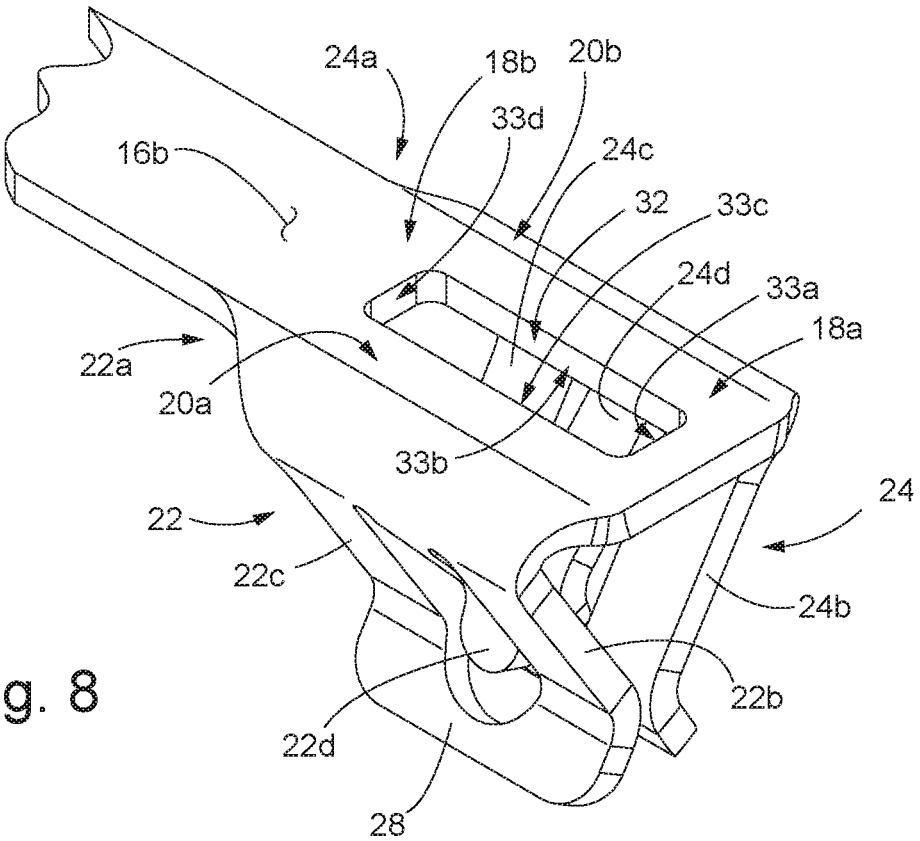
FIG. 8 is an enlarged bottom perspective view of the bus bar contact receptacle.
Figure 12:
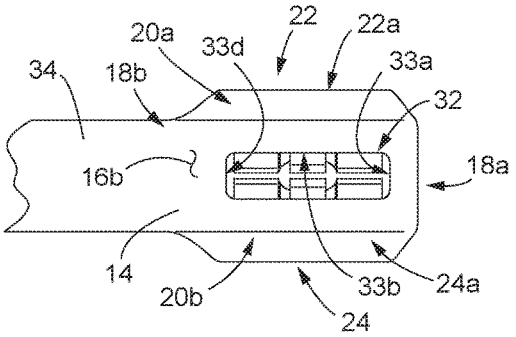
FIG. 12 is a bottom plan view of the bus bar contact receptacle.

Optionally, and as best shown in FIGS. 7, 8 and 12, base 14 defines a through-opening 32 formed or established between the forward (distal) and rearward (proximal) end regions 18*a*, 18*b* and between the left and right side edge regions 20*a*, 20*b*. Opening 32 is defined by interior or inwardly-facing surfaces 33*a-d* of base 14 (FIGS. 8 and 12), which surfaces 33*a-d* are substantially perpendicular to front surface 16*a* and rear surface 16*b*. Opening 32 is sized and shaped to receive a tip portion 30*a* of blade terminal 30 for engagement with the inner contact surfaces of the forward arms 22*b*, 24*b*, the rearward arms 22*c*, 24*c*, and the middle arms 22*d*, 24*d* of the left and right contact portions 22, 24. Opening 32 can be formed in an oval or rectangular shape, for example, and in the illustrated embodiment (as best shown in FIGS. 8 and 12) inwardly-facing surfaces 33*a-d* are arranged in a generally rectangular shape with rounded interior corners.

It will be appreciated that tip portion 30*a* of blade terminal 30 can be inserted from above or from the front (FIGS. 4 and 5), from below or from the rear (FIG. 6), and from either side or end (forward or distal end insertion shown in FIG. 3), and in each case will establish at least six points of contact with electrical bus bar contact receptacle 10 at the forward arms 22*b*, 24*b*, the rearward arms 22*c*, 24*c*, and the middle arms 22*d*, 24*d* of the left and right contact portions 22, 24. It will further be appreciated that contact receptacle 10 can establish one or more additional points or areas of contact with blade terminal 30 or bus bar 12 along front or top surface 16*a* (i.e., on either end of opening 32, and/or at forward and rearward end regions 18*a*, 18*b* of base 14) when the blade terminal 30 or bus bar 12 is fully inserted in a parallel orientation from above or from one end, such as shown in FIGS. 1-3. When blade terminal 30 or bus bar 12 is inserted in a perpendicular orientation from above (FIGS. 4 and 5) or from below or behind (FIG. 6), contact receptacle 10 can establish one or more additional points or areas of contact with blade terminal 30 where the blade terminal contacts one or more of the interior or inwardly-facing surfaces 33*a-d* of base 14.

Figure 15A:
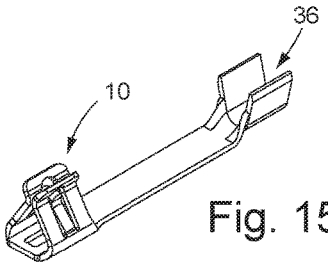
FIGS. 15A-15F are perspective views of other bus bar contact receptacle in accordance with the present invention, having different receptacle configurations and orientations.
Figure 15B:
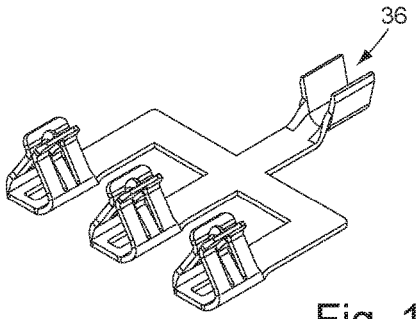
Figure 15C:
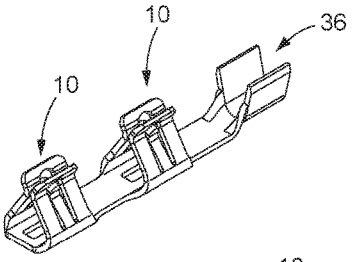
Figure 15D:
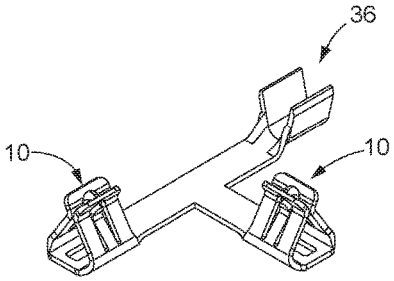
Figure 15E:
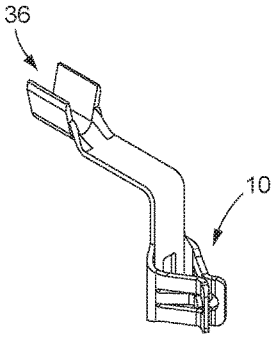
Figure 15F:
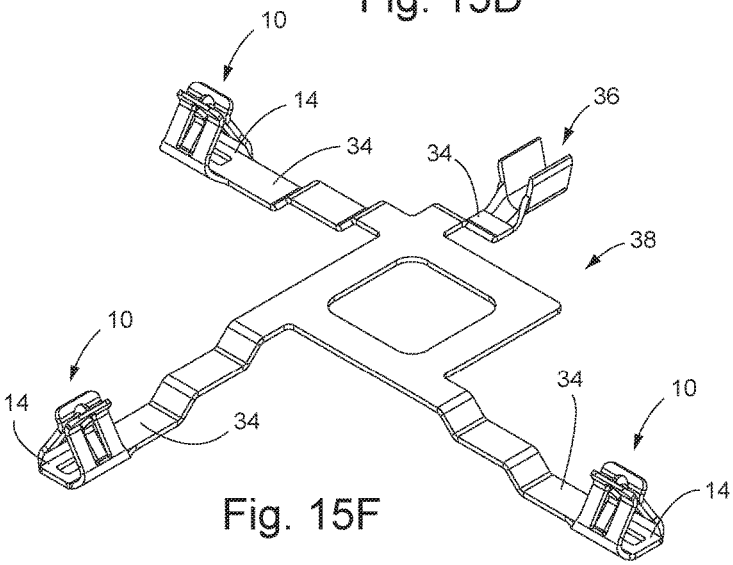

Optionally, two or more contact receptacles 10 may be provided along a single contact, such as shown in FIGS. 1, 2, 15B-15D and 15F. For example, two or more contact receptacles 10 may be placed in-line and parallel with one another, such as shown in FIGS. 1, 2 and 15C. Contact receptacles 10 may also be arranged in parallel side-by-side arrangement (FIG. 15B), in perpendicular or orthogonal arrangement (FIGS. 15D and 15F), and can be angled, vertically or horizontally offset, or combinations thereof, such as shown in FIGS. 15E and 15F. Each electrical bus bar contact receptacle 10 of FIGS. 1, 2, 15B-D and 15F includes a generally flat or planar conductor 34 that, in the embodiments of FIGS. 15A-15F, includes another connector portion 36 that may be crimped onto a wire or cable or other electrical conductor, to provide an electrical infeed or outfeed to or from contact receptacles 10. Referring to FIG. 15F, conductor 34 joins to a generally square central base 38 from which three contact receptacles 10 branch off in different directions and to different elevations, while their respective bases 14 remain generally parallel to central base 38, although it will be appreciated that bases 14 may be coplanar with central base 38.

Accordingly, the electrical bus bar contact receptacle of the present invention provides multiple points or discrete areas of contact with a bus bar, male blade terminal, or the like, to thereby establish a low-resistance electrical contact capable of carrying relatively high current loads for its size. The receptacle is configured to receive a bus bar and/or blade terminal from multiple different directions, so that the contact receptacle is versatile in substantially any given orientation. Multiple contact receptacles can be placed within a desired circuit to establish a desired amount of contact surface area, further improving the versatility of the connections available.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An electrical contact receptacle comprising:

a base having a front surface and opposite side edge regions, wherein said base comprises inwardly-facing surfaces defining a through-opening between said opposite side edge regions;

opposed contact portions extending forwardly of said front surface from respective ones of said opposite side edge regions, wherein each of said contact portions has a respective inner contact surface for conductively engaging a respective opposite planar face of a blade terminal or a bus bar;

wherein said through-opening is sized and shaped to receive the blade terminal or bus bar in a first orientation in which a longitudinal axis of the blade terminal or bus bar is perpendicular to said base with at least one of said inwardly-facing surfaces conductively engaging the blade terminal or bus bar at said opening simultaneously with said inner contact surfaces conductively engaging the respective opposite planar faces of the blade terminal or bus bar; and wherein said front surface of said base is configured to conductively engage a side edge of the blade terminal or bus bar in a second orientation in which the longitudinal axis of the blade terminal or bus bar is parallel to said base simultaneously with said contact portions conductively engaging the respective opposite planar surfaces of the blade terminal or bus bar.

2. The electrical contact receptacle of claim 1, wherein said base is substantially planar and said contact portions are angled inwardly toward one another in the forward direction.

3. The electrical contact receptacle of claim 1, wherein said base comprises forward and rearward end regions at opposite ends of said through-opening, and wherein said opposed contact portions each comprise a forward arm proximate said forward end region of said base, and a rearward arm proximate said rearward end region of said base, wherein said rearward arms and said forward arms are spaced apart from one another, and each comprises a respective one of said inner contact surfaces for conductively engaging the blade terminal or bus bar.

4. The electrical contact receptacle of claim 3, wherein said opposed contact portions each comprise a middle arm disposed between said forward and rearward end regions of said base and having distal end portions, wherein said middle arms are spaced apart from each of said forward and rearward arms, and said distal end portions of said middle arms comprise respective additional ones of said inner contact surfaces for conductively engaging the blade terminal or bus bar.

5. The electrical contact receptacle of claim 4, wherein said opposed contact portions each comprise a bridge extending transversely between and conductively attached to respective distal end portions of said forward and rearward arms.

6. The electrical contact receptacle of claim 4, wherein each of said inner contact surfaces of said opposed contact portions comprises a convex curved shape.

7. The electrical contact receptacle of claim 6, wherein said inwardly-facing surfaces of said base are substantially perpendicular to said front surface.

8. The electrical contact receptacle of claim 1, wherein said base comprises forward and rearward end regions at opposite ends of said through-opening, wherein each of said forward and rearward end regions and each of said opposite side edge regions comprises a respective portion of said front surface, and wherein each of said forward and rearward end regions and each of said opposite side edge regions is coplanar and is each configured to engage the side edge of the blade terminal or bus bar in the second orientation at a location spaced centrally between said opposite side edge regions.

9. The electrical contact receptacle of claim 8, wherein said base is generally rectangular in shape, and wherein said through-opening is generally rectangular in shape.

10. The electrical contact receptacle of claim 8, further comprising an electrical infeed or outfeed conductor coupled to said rearward end region of said base.

11. The electrical contact receptacle of claim 10, wherein said electrical infeed or outfeed conductor comprises a crimp connector spaced apart from said base, and wherein said electrical infeed or outfeed conductor is substantially planar and parallel to said base.

12. The electrical contact receptacle of claim 1, wherein said inwardly-facing surfaces of said base are substantially perpendicular to said front surface.

13. An electrical contact receptacle comprising:

a base having a planar front surface, forward and rearward end regions, and left and right side edge regions, wherein said base comprises inwardly-facing surfaces defining an opening spaced inwardly from each of said forward and rearward end regions and said left and right side edge regions;

left and right contact portions having respective distal end portions spaced outwardly from said front surface and having respective proximal end portions coupled to said left and right side edge regions of said base;

said left and right contact portions each comprising a forward arm proximate said forward end region of said base, a rearward arm proximate said rearward end region of said base, and a middle arm disposed between said forward and rearward end regions of said base;

a blade terminal or bus bar having a longitudinal axis, opposite planar faces on opposite sides of said longitudinal axis, and a pair of side edges along opposite sides of said opposite planar faces;

wherein each of said distal end portions of said forward arms, said rearward arms, and said middle arms comprises an inner contact surface for conductively engaging said opposite planar faces of said blade terminal or bus bar;

wherein said opening is sized and shaped to receive said blade terminal or bus bar in a first orientation in which a longitudinal axis of the blade terminal or bus bar is perpendicular to said base with at least one of said inwardly-facing surfaces conductively engaging the blade terminal or bus bar at said opening simultaneously with said inner contact surfaces conductively engaging the respective opposite planar faces of the blade terminal or bus bar;

wherein said front surface of said base is configured to conductively engage one of said side edges of the blade terminal or bus bar in a second orientation in which the longitudinal axis of the blade terminal or bus bar is generally parallel to said base simultaneously with said contact portions conductively engaging the respective opposite planar surfaces of the blade terminal or bus bar; and wherein said proximal end portion of said left contact portion is spaced laterally apart from said proximal end portion of said right contact portion by a first distance generally corresponding to a width of said base from said left side edge region to said right side edge region, and when said inner contact surfaces engage the blade terminal or bus bar, said inner contact surfaces of said left contact portion are spaced laterally apart from said inner contact surface of said right contact portion by a second distance that is less than said first distance.

14. The electrical contact receptacle of claim 13, wherein said opening is sized and shaped to receive the blade terminal or bus bar when the blade terminal or bus bar is oriented to project outwardly through said front surface for engagement with said inner contact surfaces of said forward arms, said rearward arms, and said middle arms.

15. The electrical contact receptacle of claim 14, wherein said inwardly-facing surfaces of said base are substantially perpendicular to said front surface.

16. The electrical contact receptacle of claim 13, wherein said base and said left and right contact portions are configured so that when in the second orientation a side edge of the blade terminal or bus bar is supported in conductive engagement with a central region of said front surface between said left and right side edge regions.

17. The electrical contact receptacle of claim 13, wherein said base and said left and right contact portions are configured so that said blade terminal or bus bar is substantially perpendicular to said base upon engagement of said blade terminal or bus bar by said inner contact surfaces of said forward arms, said rearward arms, and said middle arms.

18. The electrical contact receptacle of any of claim 13, further comprising a flat electrical infeed or outfeed conductor coupled to said base, wherein said flat electrical infeed or outfeed conductor is substantially parallel to said base.

19. The electrical contact receptacle of claim 17, wherein said flat electrical infeed or outfeed conductor is coupled to said base at said rearward end region thereof.

20. The electrical contact receptacle of claim 13, wherein each of said left and right contact portions comprises a bridge portion extending transversely between and conductively attached to respective distal end portions of said forward and rearward arms.

* * * * *